US005144269A

United States Patent [19]

Itoh

[11] Patent Number: 5,144,269

[45] Date of Patent: Sep. 1, 1992

[54] DIELECTRIC FILTER HAVING EXTERNAL CONNECTION FORMED ON DIELECTRIC SUBSTRATE

[75] Inventor: Atsushi Itoh, Daitoh, Japan

[73] Assignee: Sanyo Electric Co., Ltd., Moriguchi, Japan

[21] Appl. No.: 671,615

[22] Filed: Mar. 19, 1991

[30] Foreign Application Priority Data

Mar. 20, 1990 [JP] Japan ..... 2-71651
Jul. 24, 1990 [JP] Japan ..... 2-196572

[51] Int. Cl.[5] ..... H01P 1/202
[52] U.S. Cl. ..... 333/206; 333/222
[58] Field of Search ..... 333/202, 206, 207, 222, 333/219, 223

[56] References Cited

U.S. PATENT DOCUMENTS

Re. 32,768 10/1988 D'Avello et al. ..... 333/202
4,937,542 6/1990 Nakatuka ..... 333/222 X
5,045,824 9/1991 Metroka ..... 333/206

FOREIGN PATENT DOCUMENTS 0208424 1/1987 European Pat. Off. ..... 333/206
0141601 11/1981 Japan ..... 333/223
0119901 7/1984 Japan ..... 333/202
62-44566 11/1987 Japan .
0033901 2/1988 Japan ..... 333/206
0169802 7/1988 Japan ..... 333/202
0125001 5/1989 Japan ..... 333/202

*Primary Examiner*—Eugene R. LaRoche
*Assistant Examiner*—Seung Ham
*Attorney, Agent, or Firm*—Armstrong, Nikaido, Marmelstein, Kubovcik & Murray

[57] ABSTRACT

A dielectric filter includes: a plurality of coaxial resonators and external connectors; each of the coaxial resonators includes a dielectric block having an outer peripheral surface and an inner peripheral surface parallel to a common axis and having two end faces, a conductive layer formed on the outer and inner peripheral surfaces and on one of the end faces, and a depressed part for accepting the external connection means and formed by removing a portion of the conductive layer on at least the outer peripheral surface in the vicinity of the other end face; and the external connectors includes a dielectric substrate, and an external connection electrode formed on the dielectric substrate and capacitance-coupled with the conductive layer on the inner peripheral surface.

11 Claims, 6 Drawing Sheets

DIELECTRIC FILTER HAVING EXTERNAL CONNECTION FORMED ON DIELECTRIC SUBSTRATE

BACKGROUND OF THE INVENTION

Field of the Invention

The present invention relates to dielectric filters.

Description of the Background Art

As a dielectric filter employing a dielectric coaxial resonator, the one disclosed in, for example, Japanese Utility Model Publication No. 62-44566 (H01P1/205) has been conventionally known.

The dielectric filter of this type is structured as follows: one-end face short-circuited type coaxial resonators are disposed on a dielectric substrate. The coaxial resonators each comprise a dielectric member having a through hole formed therein. Each of the coaxial resonators is formed by coating a conductive member, e.g., silver (Ag) over an outer peripheral surface of the dielectric member and over an inner peripheral surface of the through hole. Electrodes formed on the dielectric substrate are capacitance-coupled to the respective coaxial resonators.

In recent years, communication apparatus have been reduced in scale and weight in the field of mobile communication. With the scale and the weight of the communication apparatus decreasing, smaller-scale dielectric filters have been required.

In the manufacture of a smaller-scale dielectric filter, a ratio of an inner coaxial diameter to an outer coaxial diameter must be 3.6 in order to obtain a high Qu value (unloaded Q value). If the outer coaxial diameter is less than or equal to 4 mm, however, the inner coaxial diameter is less than or equal to 1.2 mm. It is thus difficult to insert a member for external connection into the through holes of the coaxial resonators to connect the same with an external circuit as disclosed in the above-described publication.

SUMMARY OF THE INVENTION

In view of such conventional art, an object of the present invention is to provide a smaller-scale dielectric filter having a higher Qu value.

Another object of the present invention is to provide a smaller-scale dielectric filter that can easily be manufactured.

A dielectric filter in accordance with the present invention includes: a plurality of coaxial resonators each having one end face short-circuited and including an outer peripheral conductor and an inner peripheral conductor formed by coating a conductive member over an outer peripheral surface and an inner peripheral surface, respectively; a depressed part formed by removing a portion of the outer peripheral conductor on the open face side of the coaxial resonators or removing a portion of the outer peripheral conductor including a dielectric member; and a dielectric substrate having at least an electrode for external coupling formed thereon and mounted on the depression part.

According to another aspect, a dielectric filter in accordance with the present invention includes: coaxial resonators each having one end face short-circuited, in which at least two holes are formed in a dielectric member, and an outer peripheral conductor and inner peripheral conductor are formed by coating a conductive member on both outer and inner peripheral surfaces of the dielectric member; a first depressed part formed by removing a portion of the outer peripheral conductor on the open face side of an input-side coaxial resonator or removing a portion of the outer peripheral conductor including the dielectric member; a second depressed part formed by removing a portion of the outer peripheral conductor on the open face side of an output-side coaxial resonator or removing a portion of the outer peripheral conductor including the dielectric member; and a dielectric substrate having electrodes for external coupling and mounted on the depressed parts.

According to still another aspect, a dielectric filter in accordance with the present invention includes: a coaxial resonator having one end face short-circuited and including an outer peripheral conductor and inner peripheral conductor formed by coating a conductive member on outer and inner peripheral surfaces of a dielectric block having at least one hole therein; a depressed part formed by removing a portion of the outer peripheral conductor of this coaxial resonator or removing a portion of the outer peripheral conductor including the dielectric block; and a dielectric substrate having an electrode for external connection and mounted on the depressed part. In this dielectric filter, a dielectric member is disposed between the depression part and the dielectric substrate.

In accordance with the present invention, an external circuit and a coaxial resonator is coupled with each other through an electrode for external connection provided on a dielectric substrate, by first forming a depressed part by removing a portion of an outer peripheral conductor on the open face side of the coaxial resonator or by removing a portion of the outer peripheral conductor including a dielectric member, and then mounting the dielectric substrate on the depressed part.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

FIGS. 1A, 1B, 2A and 2B show a first embodiment of the present invention. Referring to these figures, a coaxial resonator 1 having its one end face short-circuited comprises a prism-like dielectric member 1*a* having a through hole 1*b* formed therein, and an outer peripheral conductor 1*c* and an inner peripheral conductor 1*d* formed by coating a conductive member, e.g., silver (Ag) over an outer peripheral surface and an inner peripheral surface of dielectric member 1*a*. A depressed part 2 is formed by removing a portion of outer peripheral conductor 1*c* on the open face side of coaxial resonator 1 or removing a portion of outer peripheral conductor 1*c* including dielectric member 1*a*. A dielectric substrate 3 is mounted on depressed part 2. A connection electrode 3*a* having a width W and a ground electrode 3*b* are provided on dielectric substrate 3.

Figure 1A:
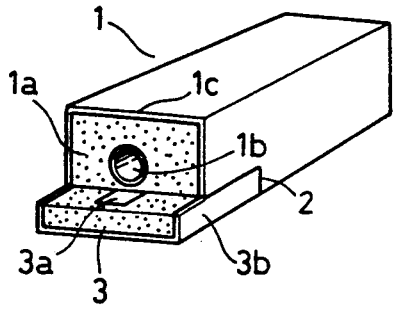
FIG. 1A is an overview showing a first embodiment of the present invention.
Figure 1B:
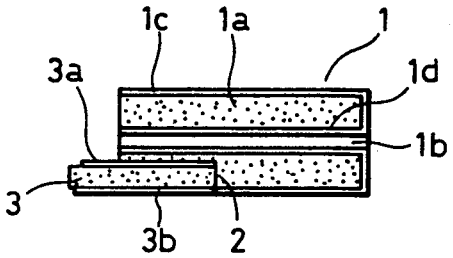
FIG. 1B is a sectional side elevation view showing the first embodiment.
Figure 2A:
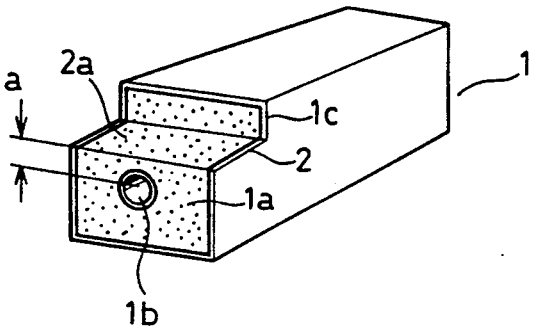
FIG. 2A is a view showing a coaxial resonator according to the first embodiment.
Figure 2B:
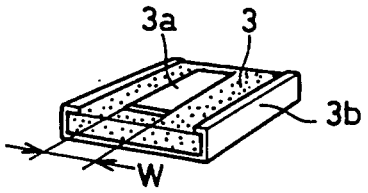
FIG. 2B is a view showing a dielectric substrate.
Figure 3:
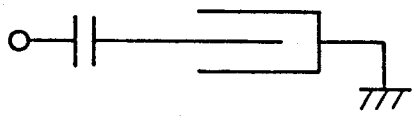
FIG. 3 is an equivalent circuit diagram according to the first embodiment.

According to the first embodiment, a coupling capacitance is provided between connection electrode 3*a* formed on dielectric substrate 3 and inner peripheral conductor 1*d* of coaxial resonator 1. This coupling capacitance is shown in FIG. 3 as represented by an equivalent circuit.

Figure 4A:
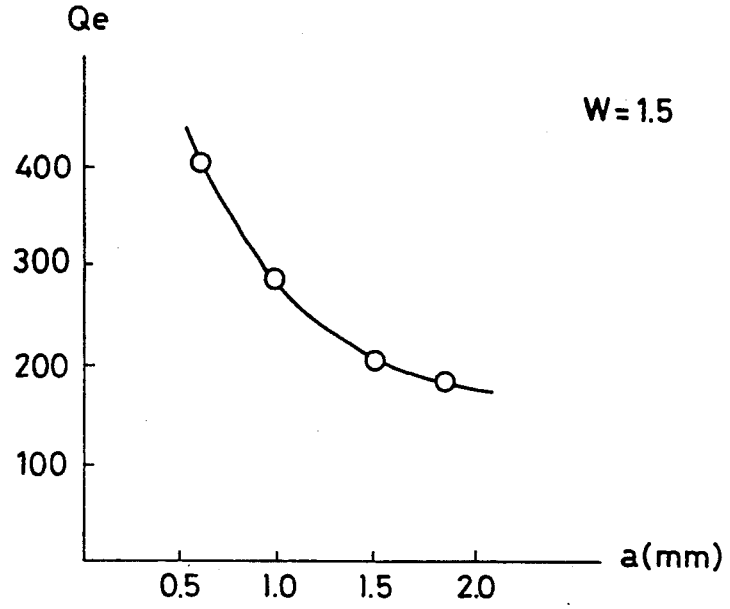
FIGS. 4A and 4B are characteristic views for use in explaining the present invention.
Figure 4B:
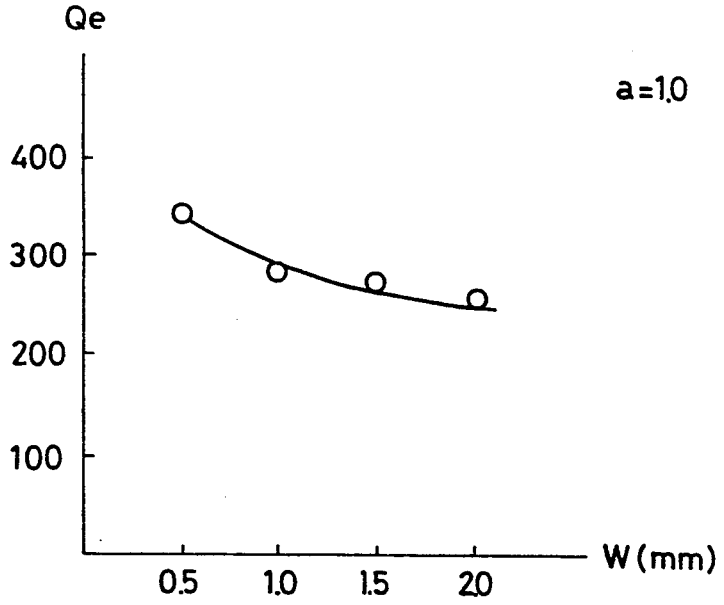

The degree of coupling in accordance with the first embodiment is determined by the distance a between inner peripheral conductor 1*d* of coaxial resonator 1 and a lower surface 2*a* of depression part 2 and by the width W of connection electrode 3*a*. Changes in the degree of coupling represented by Qe (external Q value) are shown in FIGS. 4A and 4B. FIG. 4A shows the case where the width W of connection electrode 3*a* is definite and the distance a is variable. FIG. 4B shows the case where the distance a is definite and the width W of connection electrode 3*a* is variable.

Figure 5A:
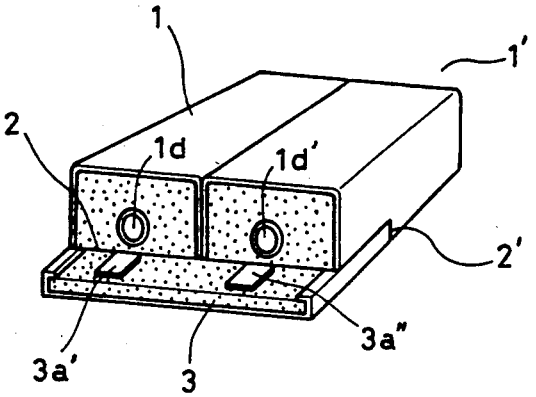
FIG. 5A is a view showing a second embodiment of the present invention.
Figure 5B:
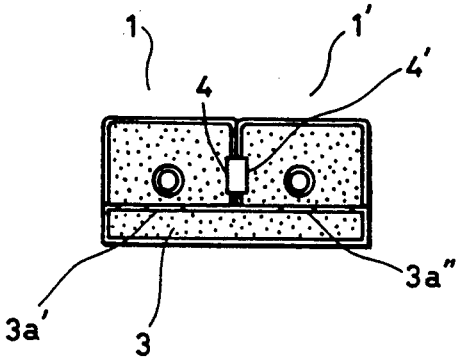
FIG. 5B is a transverse sectional view of the second embodiment.
Figure 6:
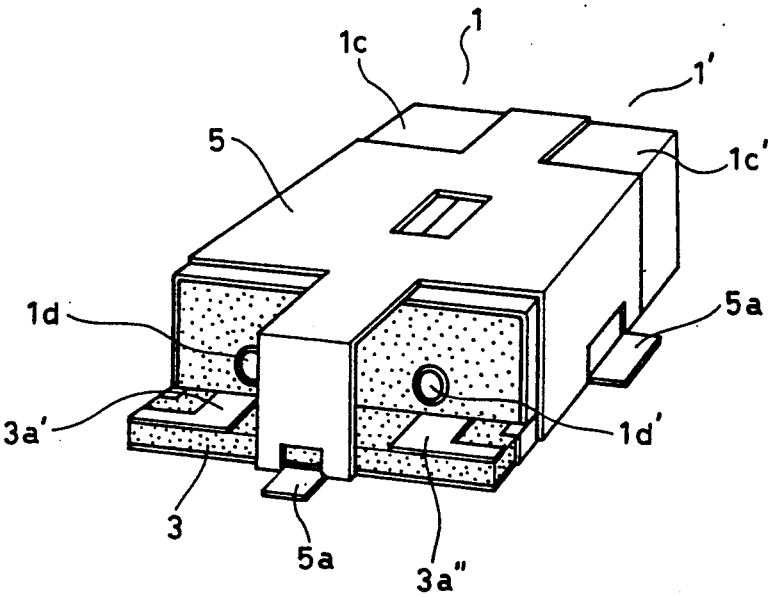
FIG. 6 is a view showing the coaxial resonator accommodated in a metal casing.

FIGS. 5A, 5B and 6 are views showing a second embodiment of the present invention, showing an example in which a dielectric filter comprises a first coaxial resonator 1 and a second coaxial resonator 1'. First coaxial resonator 1 is used as the one on an input side, while second coaxial resonator 1' is used as the one on an output side. Depressed parts 2 and 2' are formed in first and second coaxial resonators 1 and 1' respectively. A dielectric substrate 3 having a connection electrode 3*a*' on the input side and a connection electrode 3*a*'' on the output side is mounted in the respective depression parts 2 and 2'. In the same manner as in the foregoing description, respective connection electrodes 3*a*' and 3*a*'' are coupled with respective inner peripheral conductors 1*d* and 1*d*' of coaxial resonators 1 and 1'.

A coupling between those coaxial resonators (interstage coupling) is achieved by connecting windows 4 and 4' formed by removing a portion of the outer peripheral conductor of each coaxial resonator, as shown in FIG. 5B.

Coaxial resonators 1 and 1' thus structured and dielectric substrate 3 are accommodated in a metal casing 5, and outer peripheral conductors 1*c* and 1*c*' and metal casing 5 are then electrically connected with each other by solder or the like. Thus, a dielectric filter is completed. Metal casing 5 is provided with a ground terminal 5*a* connected to a ground pattern or the like of a print-circuit board on which the dielectric filter is mounted.

FIGS. 7A, 7B, 8A and 8B are views showing a third embodiment of the present invention, showing an example in which a dielectric filter comprises a first coaxial resonator 1 and a second coaxial resonator 1'. The third embodiment is different from the second embodiment in formation of a dielectric substrate 30.

Figure 8A:
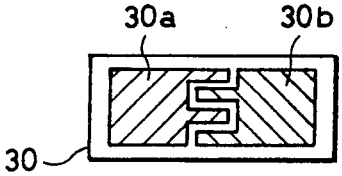
FIG. 8A is a top view of a dielectric substrate according to the third embodiment.
Figure 8B:
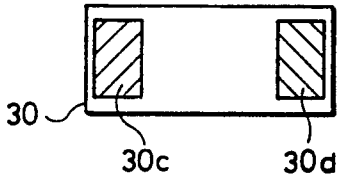
FIG. 8B is a bottom view of the dielectric substrate.

In the third embodiment, as shown in FIGS. 8A and 8B, coupling electrodes 30*a* and 30*b* are respectively connected to the respective inner peripheral conductors of the coaxial resonators through metal wires 31 or a conductive paste, to provide a coupling capacitance at a non-metal-plated portion formed between the coupling electrodes. The coupling electrodes are provided on an upper face of dielectric substrate 30 mounted in a depressed part 2 of the first and second coaxial resonators (i.e., the face of dielectric substrate 30, which is to be mounted in the depressed part). External connection electrodes 30*c* and 30*d* connecting with an external circuit are provided on a lower face of dielectric substrate 30.

In the third embodiment, dielectric substrate 30 is mounted in depressed part 2 of first and second coaxial resonators 1 and 1'. Coupling electrodes 30*a* and 30*b* of this dielectric substrate 30 and inner peripheral conductors 1*d* and 1*d*, of respective coaxial resonators 1 and 1' are connected with each other through metal wires 31 or the conductive paste, so that a dielectric filter is constructed.

The coaxial resonators and the external circuit are connected with each other through the coupling capacitance provided by coupling electrodes 30*a* and 30*b* and external connection electrodes 30*c* and 30*d*.

Figure 9A:
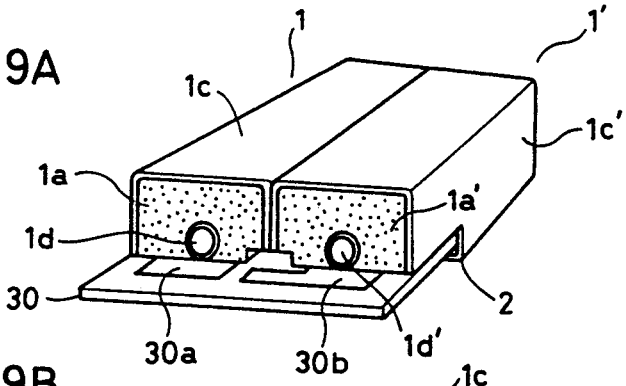
FIG. 9A is a view showing a fourth embodiment of the present invention.
Figure 9B:
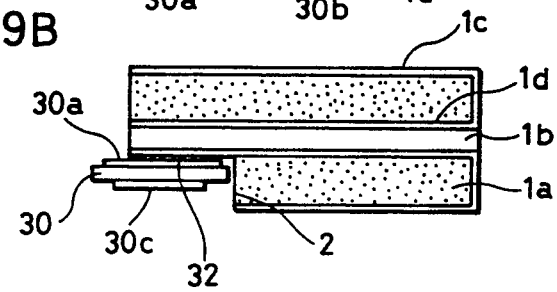
FIG. 9B is a sectional side elevation view of the fourth embodiment.

FIGS. 9A and 9B show a fourth embodiment of the present invention, showing an example in which a depressed part 2 is formed by removing portions of outer peripheral conductors 1*c* and 1*c*' on the open face side of a first coaxial resonator 1 and a second coaxial resonator 1' or by removing portions of the outer peripheral conductors including dielectric materials 1*a* and 1*a*', extending over inner peripheral conductors.

In this case, a dielectric filter is constructed by mounting a dielectric substrate 30 in depressed part 2 of first and second coaxial resonators 1 and 1' by a conductive adhesive agent 32. The connection between coupling electrodes 30*a* and 30*b* of dielectric substrate 30 and inner peripheral conductors 1*d* and 1*d*' of the coaxial resonators is made simultaneously with the mounting of dielectric substrate 30 in depressed part 2 by employing the above-described conductive adhesive agent 32.

Figure 7A:
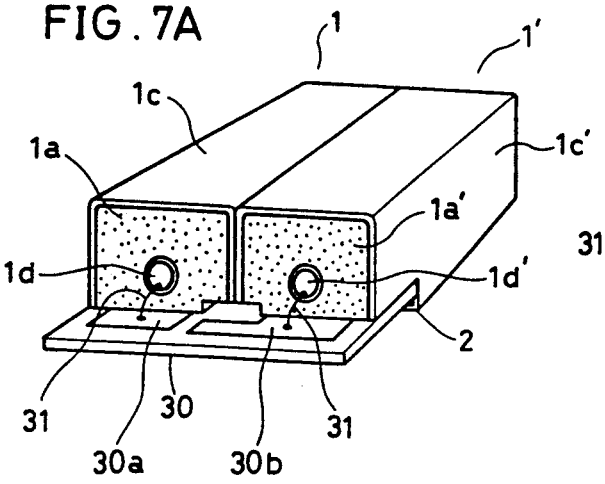
FIG. 7A is a view showing a third embodiment of the present invention.
Figure 7B:
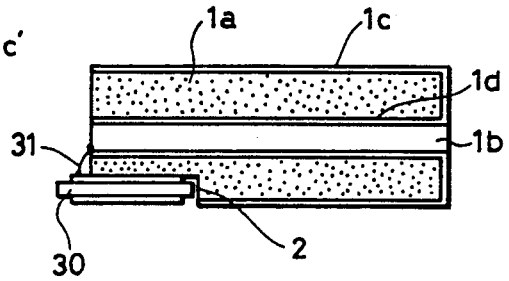
FIG. 7B is a sectional side elevation view of the third embodiment.
Figure 10:
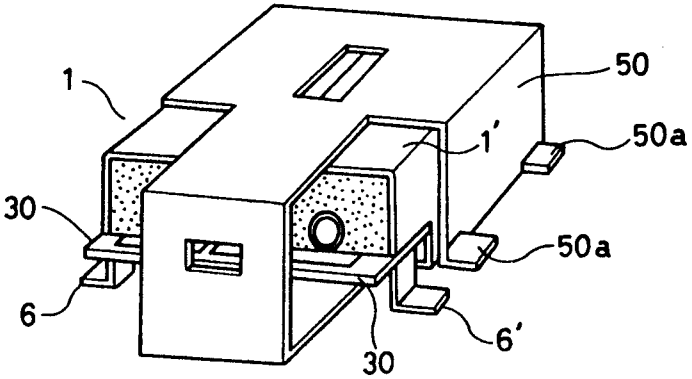
FIG. 10 is a view showing the dielectric filters of the third and fourth embodiments both accommodated in a metal casing.

FIG. 10 shows a state where the dielectric filter of FIGS. 7A and 7B or the one of FIGS. 9A and 9B is accommodated in a metal casing 50. This metal casing 50 is provided with ground terminals 50*a* which are connected with ground patterns or the like of a print-circuit board on which the dielectric filter is mounted. Connection terminals 6 and 6' are connected respectively to external connection electrodes 30*a* and 30*b* of a dielectric substrate 30.

Figure 11:
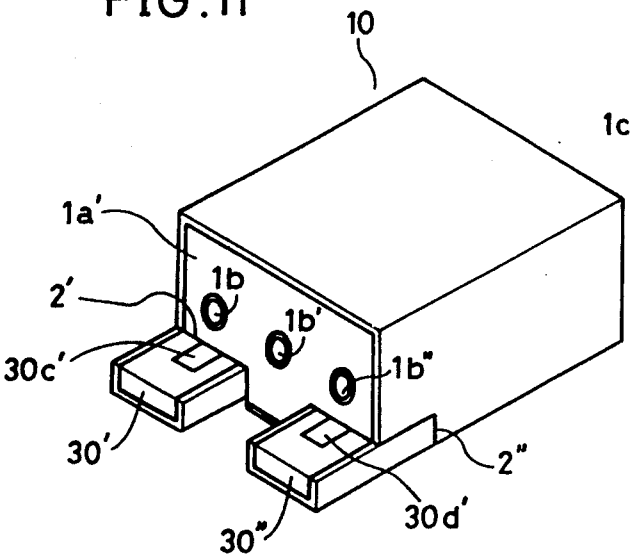
FIG. 11 is a view showing a fifth embodiment of the present invention.

FIG. 11 is a diagram showing a fifth embodiment of the present invention, showing an example of a dielectric filter 10 including a plurality of coaxial resonators each having one end face short-circuited. In such coaxial resonators, a plurality of through holes 1*b*, 1*b'* and 1*b''* are formed in a dielectric member 1*a'*, and a conductive member is coated over an outer peripheral surface and an inner peripheral surface of the dielectric member, so as to form an outer peripheral conductor 1*c* and an inner peripheral conductor.

In the fifth embodiment, a first depressed part 2' is formed by removing a portion of the outer peripheral conductor on the open face side of an input-side coaxial resonator or by removing a portion of the outer peripheral conductor including the dielectric member A dielectric substrate 30' having an electrode 30*c*, for external connection is mounted in this first depressed part 2'. Then, a second depression part 2'' is formed by removing a portion of the outer peripheral conductor on the open face side of an output-side coaxial resonator or by removing a portion of the outer peripheral conductor including the dielectric member. A dielectric substrate 30,, having an electrode 30*d'* for external connection is then mounted in second depression part 2''. According to the fifth embodiment, a coupling capacitance is provided between the inner peripheral conductors of the coaxial resonators and external connection electrodes 30*c'* and 30*d'*.

Figure 12:
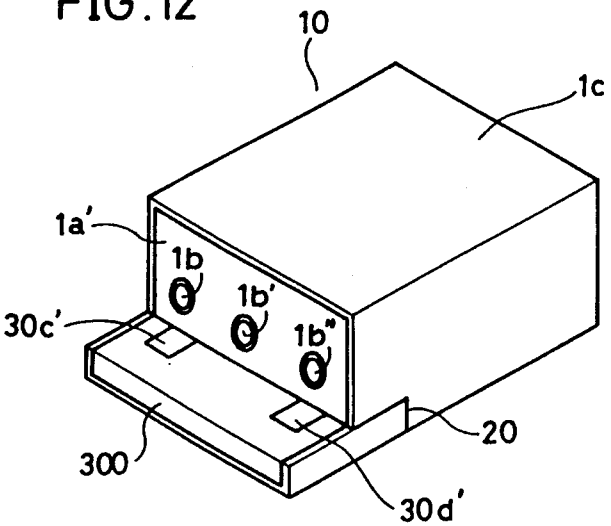
FIG. 12 is a view showing a sixth embodiment of the present invention.

FIG. 12 is a diagram showing a sixth embodiment of the present invention, showing an example in which as compared with the fifth embodiment, a depressed part 20 is formed over the entire open face side of the coaxial resonators, and a single dielectric substrate 300 is mounted in depression part 20.

Each of the dielectric filters of the fifth and sixth embodiments is mounted on a print-circuit board after accommodated in a metal casing in the same manner as in the other embodiments.

FIGS. 13A,13B, 13C and 13D show a seventh embodiment of the present invention. In this embodiment, as compared with the second embodiment, a dielectric member 100 having a viscosity or elasticity and made such as of cyanoacrylate, silicone grease, silicone resin or epoxy resin is provided between a depression part 2 and a dielectric substrate 3. The provision of dielectric member 100 enhances a coupling efficiency of the capacitive coupling between a resonator and a connection electrode.

According to the second embodiment, if the form of the depression part of the resonator is 1.0×3.5 mm in size and the width of the connection electrode is 2.5 mm, a dielectric filter having a center frequency of 860 MHz, a bandwidth of 15 MHz and an insertion loss of 3.0 dB can be obtained. According to the seventh embodiment, a dielectric filter having a center frequency of 860 MHz, a bandwidth of 33 MHz and an insertion loss of 1.5 dB can be obtained.

As apparent from the foregoing description, the filter which requires a wider band and a lower insertion loss can be attained according to the seventh embodiment.

Figure 13B:
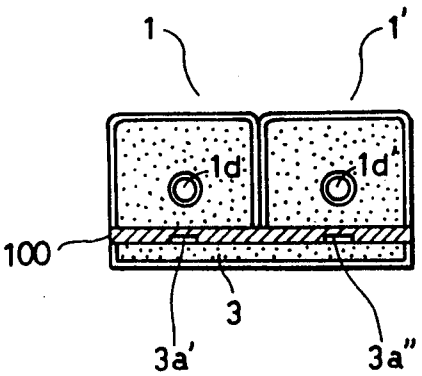
FIG. 13B is a front view of the seventh embodiment.
Figure 13D:
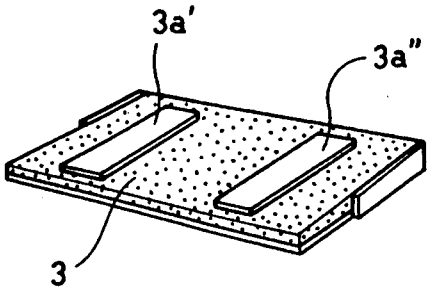
FIG. 13D is a view showing a dielectric substrate according to the seventh embodiment.
Figure 13A:
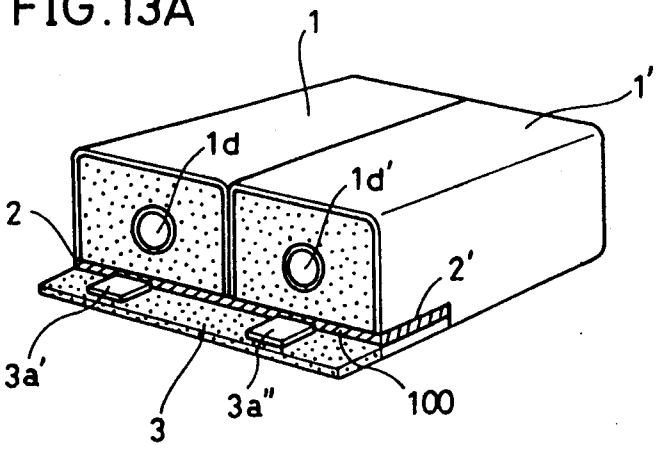
FIG. 13A is an overview showing a seventh embodiment of the present invention.
Figure 13C:
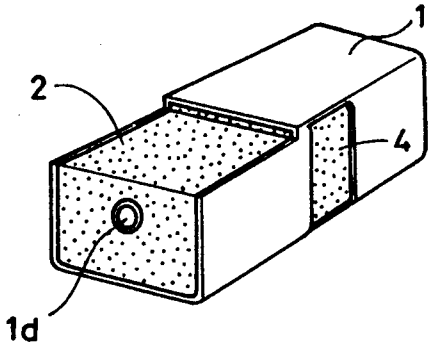
FIG. 13C is an overview of the coaxial resonator according to the seventh embodiment.

In consideration of the fact that electromagnetic field distributions of TEM resonance are generated vertically to an inner common axis and that the electromagnetic field distributions are in an inductive state on the short-circuited end side and in a capacitive state on the open end side, a window 4 for coupling the resonators is formed in central portions of the resonators and in a direction in which an elongated direction is orthogonal to the inner common axis, as shown in FIG. 13C, in order to strengthen the coupling between the resonators and enhance the symmetricalness of filter characteristics.

The present invention is, however, not limited to the foregoing descriptions. For example, an external connection electrode may be formed in a direction orthogonal to the elongated direction of the coaxial resonators instead of the elongated direction as shown in the first or second embodiment, so as to be provided on the side portion of the dielectric filter.

In accordance with the present invention, since a dielectric substrate having at least an external connection electrode is mounted in a depression part formed by removing a portion of an outer peripheral conductor on the open face side of a coaxial resonator or by removing a portion of the outer peripheral conductor including a dielectric member, the connection between the coaxial resonator and an external circuit is ensured and also a surface mounting is enabled, even in the case with a smaller outer coaxial diameter in reducing the size of a dielectric filter. In addition, since the length of the connection line between the external connection electrode and the external circuit can be reduced, capacitance components and induction components parasitically generated in that portion can be reduced, thereby suppressing influences on characteristics due to differences in mounting states. Moreover, the provision of the dielectric member between the depression part and the dielectric substrate attains a dielectric filter having a wider band and a lower insertion loss.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dielectric filter comprising:

a plurality of coaxial resonators; and external connection means, each said coaxial resonator including a dielectric block having an outer peripheral surface and inner peripheral surfaces parallel to a common axis and having first and second end faces crossing over said common axis, first and second conductive layers formed respectively on said outer peripheral surfaces and said inner peripheral surfaces, a third conductive layer formed on said second end face and connecting the first and second conductive layers, and a depressed part for receiving said external connection means and formed in juxtapose with said second conductive layers by removing at least a portion of the first conductive layer and the dielectric block on said outer peripheral surface in the vicinity of said first end face, said external connection means including an dielectric substrate, and an electrode for an external connection formed on said dielectric substrate.

2. The dielectric filter of claim 1, wherein said external connection means includes a plurality of coupling electrodes formed to be capacitance-coupled with each other on said dielectric substrate.

3. The dielectric filter of claim 1, wherein each said coaxial resonator has a window formed by removing a portion of the first conductor layer on said outer peripheral surface in order to enable the mutual coupling between said coaxial resonators.

4. The dielectric filter of claim 3, wherein said window has a rectangular form and is provided on the vicinity of a center of said outer peripheral surface in a direction along said common axis so that a longer side of said rectangle may be in parallel with a direction substantially orthogonal to said common axis.

5. A dielectric filter comprising:

external connection means;

a dielectric block having an outer peripheral surface parallel to an axis and a plurality of inner peripheral surfaces parallel to said axis and having first and second end faces crossing over said axis;

a first conductive layer formed on said outer peripheral surface;

a plurality of second conductive layers formed on said plurality of inner peripheral surfaces;

a third conductive layer formed on said second end face and connecting the first and second conductive layers; and a depressed part for receiving said external connection means and formed in juxtapose with said second conductive layers by removing at least a portion of the first conductive layer and the dielectric block on said outer peripheral surface in the vicinity of said first end face, said external connection means including a dielectric substrate, and an electrode for an external connection formed on said dielectric substrate and capacitance-coupled with one of the second conductive layers on said inner peripheral surfaces.

6. The dielectric filter of claim 5, wherein said dielectric block includes a plurality of said depressed parts in the vicinity of said first end face, and said external connection means includes a plurality of dielectric substrates and an electrode for an external connection formed on each of said dielectric substrates and capacitance-coupled with one of the second conductive layers on said inner peripheral surfaces.

7. A dielectric filter comprising:

external connection means;

a dielectric block having an outer peripheral surface parallel to an axis and at least one inner peripheral surface parallel to said axis and having first and second end faces crossing over said axis;

a first conductive layer formed on said outer peripheral surface;

a second conductive layer formed on said at least one inner peripheral surface;

a third conductive layer formed on said second end face and connecting the first and second conductive layers;

a depressed part for receiving said external connection means and formed in juxtapose with said second conductive layers by removing at least a portion of the first conductive layer on said outer peripheral surface in the vicinity of said first end face; and a dielectric layer for filling a space between said depressed part and said external connection means, said external connection means including a dielectric substrate, and an electrode for an external connection formed on said dielectric substrate and capacitance-coupled with the second conductive layer on said inner peripheral surface.

8. The dielectric filter of claim 1, wherein said electrode for an external connection is formed to be capacitance-coupled with one of the second conductive layer on said inner peripheral surface.

9. A dielectric filter comprising:

a plurality of coaxial resonators; and external connection means, each said coaxial resonator including a dielectric block having an outer peripheral surface and inner peripheral surfaces parallel to a common axis and having first and second end faces crossing over said common axis, first and second conductive layers formed respectively on said outer peripheral surface on said inner peripheral surfaces, a third conductive layer formed on said second end face and connecting the first and second conductive layers, and a depressed part for receiving said external connection means and formed in juxtapose with said second conductive layers by removing a portion of the first conductive layer including a dielectric member of said dielectric block on said outer peripheral surface in the vicinity of said first end face, said external connection means including a dielectric substrate, and an electrode for an external connection formed on said dielectric substrate.

10. A dielectric filter comprising:

external connection means;

a dielectric block having an outer peripheral surface parallel to an axis and a plurality of inner peripheral surfaces parallel to said axis and having first and second end faces crossing over said axis;

a first conductive layer formed on said outer peripheral surface;

a plurality of second conductive layers formed on said plurality of inner peripheral surfaces;

a third conductive layer formed on said second end face and connecting the first and second conductive layers; and a depressed part for receiving said external connection means and formed in juxtapose with said second conductive layers by removing a portion of the first conductive layer including a dielectric member of said dielectric block on said outer peripheral surface in the vicinity of said first end face, said external connection means including a dielectric substrate, and an electrode for an external connection formed on said dielectric substrate and capacitance-coupled with one of the second conductive layers on said inner peripheral surfaces.

11. A dielectric filter comprising:

external connection means;

a dielectric layer for filling a space between said resonator and said external connection means;

a dielectric block having an outer peripheral surface parallel to an axis and at least one inner peripheral surface parallel to said axis and having first and second end faces crossing over said axis;

a first conductive layer formed on said outer peripheral surface;

a second conductive layer formed on said at least one inner peripheral surface;

a third conductive layer formed on said second end face and connecting the first and second conductive layers;

a depressed part for receiving said external connection means and formed in juxtapose with said second conductive layers by removing a portion of the first conductive layer including a dielectric member of said dielectric block on said outer peripheral surface in the vicinity of said first end face; and a dielectric layer for filling a space between said depressed part and said external connection means, said external connection means including a dielectric substrate, and an electrode for an external connection formed on said dielectric substrate and capacitance-coupled with the second conductive layer on said inner peripheral surface.

* * * * *